US007168222B2

(12) United States Patent
Spaniel

(10) Patent No.: US 7,168,222 B2
(45) Date of Patent: Jan. 30, 2007

(54) WRAPPING DEVICE

(75) Inventor: Ralf Spaniel, Marienheide (DE)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/410,231

(22) Filed: Apr. 25, 2006

(65) Prior Publication Data

US 2006/0185330 A1 Aug. 24, 2006

Related U.S. Application Data

(62) Division of application No. 10/867,211, filed on Jun. 15, 2004, now Pat. No. 7,040,071.

(30) Foreign Application Priority Data

Jun. 16, 2003 (DE) ..... 203 09 382

(51) Int. Cl.
*B65B 11/00* (2006.01)

(52) U.S. Cl. ..... 53/210; 53/556; 53/588

(58) Field of Classification Search ..... 53/210, 53/441, 465, 556, 587, 588; 414/607, 608
See application file for complete search history.

(56) References Cited

U.S. PATENT DOCUMENTS 2,581,364 A * 1/1952 Cushman ..... 414/607
3,310,189 A * 3/1967 Vander Wal ..... 414/607
3,918,600 A * 11/1975 Lyon ..... 414/607
4,282,700 A 8/1981 Goldstein
4,821,486 A 4/1989 Oiestad
5,048,271 A 9/1991 Walton
5,230,599 A * 7/1993 Orr ..... 414/607
5,456,565 A * 10/1995 Pigott et al. ..... 414/607
5,673,542 A 10/1997 Vartanian et al.
5,897,286 A * 4/1999 Whittaker ..... 414/607
6,253,532 B1 7/2001 Orpen
6,470,657 B2 10/2002 Huson et al.
6,679,035 B1 1/2004 Viaud

FOREIGN PATENT DOCUMENTS

JP 03111214 A 5/1991

* cited by examiner

*Primary Examiner*—Louis Huynh
(74) *Attorney, Agent, or Firm*—Lowe Hauptman & Berner, LLP

(57) ABSTRACT

A wrapping device includes a base body which is connected with support elements and a holding arm. The holding arm has rotatably connected thereto a wrapping arm. The wrapping arm carries a roll holder. At the roll holders a rotatably supported film roll is arranged for being displaced in a predetermined direction for wrapping up objects arranged on a pallet. For transporting the wrapping device, the support elements serve as fastening elements and are of hollow configuration such that support elements of a lift truck can be inserted therein.

4 Claims, 3 Drawing Sheets

WRAPPING DEVICE

RELATED APPLICATIONS

The present application is a divisional application of U.S. patent application Ser. No. 10/867,211, filed Jun. 15, 2004, now U.S. Pat. No. 7,040,071 which claims benefit of German Application Serial No. 203 09 382.8, filed Jun. 16, 2003, the entire disclosures of which are hereby incorporated by reference.

BACKGROUND OF THE INVENTION

The invention relates to a wrapping device for wrapping-up objects, in particular pallets, with a film.

For transporting e. g. objects stacked on pallets, such as cardboard boxes or the like, it is common practice to wrap up the pallet, together with the objects, with a film, in particular a prestretched film. This ensures safe hold of the objects on the pallet. Wrapping-up of pallets is frequently carried out by hand. Since this procedure is however extremely personnel—and thus cost-intensive, wrapping devices, i. e. automatically operating wrapping machines, are known. Said machines comprise a turntable on which the pallet to be wrapped up is placed. For wrapping-up the pallet, the turntable is turned about a vertical axis. Further, the film roll is held on a vertically displaceable roll holder. Turning the pallet causes the film to be pulled off or wound off the film roll. In the course of this wind-off process the film roll is vertically displaced such that the pallet and/or the objects stacked on the pallet are wrapped up with film over their overall height.

Normally, the objects, such as cardboard boxes, are stacked on the pallet and the pallet is then transported to the wrapping device, for example with the aid of a lift truck. Here, the pallet is then placed on the turntable, and the lift truck must be removed to allow the pallet to be wrapped up. After automatic wrapping-up of the pallet with the aid of the wrapping device, the wrapped-up pallet can be removed by the lift truck. The automatic wrapping-up of pallets with the aid of a wrapping device or a wrapping machine has thus the drawback that the pallet must be repeatedly picked up by the lift truck or another suitable transport means.

Further, a wrapping device for wrapping-up objects on a pallet is known from JP 03111214. This wrapping device comprises an L-shaped holding arm provided with a horizontally and a vertically arranged arm. The horizontal arm has a wrapping arm connected thereto for rotation with said horizontal arm. The wrapping arm, in turn, has connected thereto a roller holder for receiving a film roll, wherein the wrapping arm is turned for the purpose of wrapping-up objects in such a manner that the film roll is guided around the objects. In the wrapping device described in JP 03111214 the holding arm is connected with a lift truck. This allows pallets to be transported with the aid of cable-like support elements of the lift truck and to be wrapped up without having to be placed onto a wrapping device with a turntable. Such a lift truck with a wrapping device has however the drawback that in particular the holding arm and the wrapping arm are interfering when the lift truck is used in a normal manner, i. e. when pallets are transported which are not intended for being wrapped up. In particular, it is always necessary to carry along a relatively large weight, which affects handling of the lift truck. Further, in particular the horizontal portion of the holding arm is interfering since said portion limits the height to which objects can be stacked on the pallet. The horizontal portion of the holding arm is, for example, also interfering when a pallet is placed into a rack or another difficult-to-access area.

SUMMARY OF THE INVENTION

It is an object of the invention to provide a wrapping device for wrapping-up objects, in particular objects arranged on a pallet, with a film, wherein said wrapping device is mobile and yet does not affect the application of a lift truck.

The wrapping device according to the invention comprises a base body containing, for example, control units and the like. The base body has connected thereto a holding arm which is preferably of L-shaped configuration and comprises substantially vertically and horizontally aligned portions. The holding arm, in particular the horizontal arm, has rotatably connected thereto a wrapping arm for wrapping-up in particular objects arranged on a pallet. According to the invention, the base body is connected to a fastening element. The fastening element serves for fastening the inventive wrapping device to support elements of a lift truck, said support elements normally being of fork-shaped configuration. It is thus possible to fasten the inventive wrapping device with the aid of the fastening elements to the support elements and/or the fork-like portions of a conventional lift truck. It is thus possible to provide a mobile wrapping device by fastening the wrapping device to the lift truck, with the aid of which mobile wrapping device e. g. pallets can be transported and wrapped up. Thus placing the pallet e. g. on a turntable of a stationary wrapping device is no longer necessary. Further, the invention offers the advantage that the wrapping device can be easily separated from the lift truck such that the lift truck can be used for normal transport etc. of pallets, wherein the functionality and the application of the lift truck are not affected by the wrapping device.

The fastening elements are preferably configured such that the wrapping device can be quickly and easily connected with and separated from the lift truck. In this connection it is particularly preferred that the fastening elements comprise recesses into which the support elements of the lift truck can be inserted. It is particularly preferred that the fastening elements are configured such that they at least partially embrace the support elements of the lift truck. It is thus possible to insert the support elements, such as the cables of the lift truck, into the recesses and in this simple manner to connect the inventive wrapping device with the lift truck. By simply pulling the support elements out of the recesses the wrapping device can be separated from the lift truck. Thus laborious installation work is not required. Rather, the fastening elements are preferably connected to the support elements by inserting or pulling out the fastening elements.

In a particularly preferred embodiment, the fastening elements of the wrapping device have substantially the same shape as the support elements of the lift truck. Such fastening elements are thus, for example, configured as a hollow fork-like portion into which the support elements and/or the fork-like portion of the lift truck can be inserted. The support elements of the lift truck are then preferably completely encompassed by the fastening elements. The fastening elements are thus configured as a hollow lift truck fork, wherein the individual fastening elements are preferably connected with each other via a stabilizing cross web. The fastening elements configured as a hollow lift truck fork offer a footprint for the wrapping device, which is sufficient to ensure stability of the wrapping device during operation without necessitating any further assistance means and without the danger of an accidental tilt. This embodiment of the fastening elements offers the further advantage that the position of the wrapping device relative to the lift truck is easily defined, i. e. by simply inserting the support elements into the fastening elements. Further, this embodiment offers a stable connection between the wrapping device and the lift truck such that even relatively large lateral forces can act upon the wrapping device.

The wrapping device according to the invention may comprise its own power supply unit, for example in the form of chargeable batteries. For reducing the weight of the wrapping device, the wrapping device preferably comprises a power supply connection for connecting the wrapping device to an external power source. It is particularly preferred to connect the wrapping device to the power supply unit of the electric lift truck since this ensures a high mobility and allows pallets to be wrapped up independent of stationary power connections.

In a further preferred embodiment of the invention, stop elements are provided for defining the position of the objects, in particular the pallet, to be wrapped up. It is thus ensured that the roll holder can be freely guided around the pallet when the pallet is wrapped up. Such stop elements are preferably provided at the fastening elements. This is particularly advantageous when the fastening elements have at least partially the same shape as the support elements of the lift truck and are in particular configured as insertion pockets. Preferably, the stop element is a wedge-shaped stop element provided on the upper side, i. e. the support surface, of the fastening elements.

Provision of a stop element is an independent invention, wherein the stop element may be provided, for example, not only on the wrapping device described above but also on a wrapping device fixed to a lift truck, in particular on the support elements. Thus the invention further relates to a pallet stop element for accepting a pallet, wherein the pallet stop element is in particular suitable for the wrapping device described above or a lift truck. According to the invention, the support element comprises on its upper side the pallet stop element for defining the position of the pallet. The stop element, i. e. the pallet stop element, comprises a friction surface for frictionally engaged holding of the pallet, the friction surface being inclined relative to the horizontal and sloping towards pallet to be picked up. The stop element is, for example, at least partially of wedge-shaped configuration such that the friction surface is defined by the side surfaces of the wedge-shaped portion of the stop element. When the stop element according to the invention accepts the pallet, the wedge-shaped portion of the stop element slightly lifts the pallet, whereby a major portion of the weight of the pallet and the goods arranged on the pallet is gradually taken up the friction surface. Thereby a large friction force is produced which defines the position of the pallet. In contrast to an e. g. rectangular stop element, the inventive stop element prevents a sudden collision of the pallet with the stop element such that the danger of damage to the pallet and/or the goods is reduced. Further, the pallet is prevented from rebounding from the stop element and thus from experiencing a dislocation such that even in the case of uncareful use of the wrapping device and/or the lift truck with which the inventive pallet stop element is connected, a defined position of the pallet relative to the support element is ensured.

Further, the invention relates to a lift truck, in particular an electric lift truck. Such lift trucks comprise support elements normally of fork-shaped configuration for transporting objects, in particular objects arranged on pallets. According to the invention, the support elements of the lift truck have connected thereto the wrapping device described above, in particular preferred variants thereof.

BRIEF DESCRIPTION OF THE DRAWING

Hereunder the invention is explained in detail in connection with a preferred embodiment with reference to the drawings in which.

DETAILED DESCRIPTION OF THE INVENTION

Figure 1:
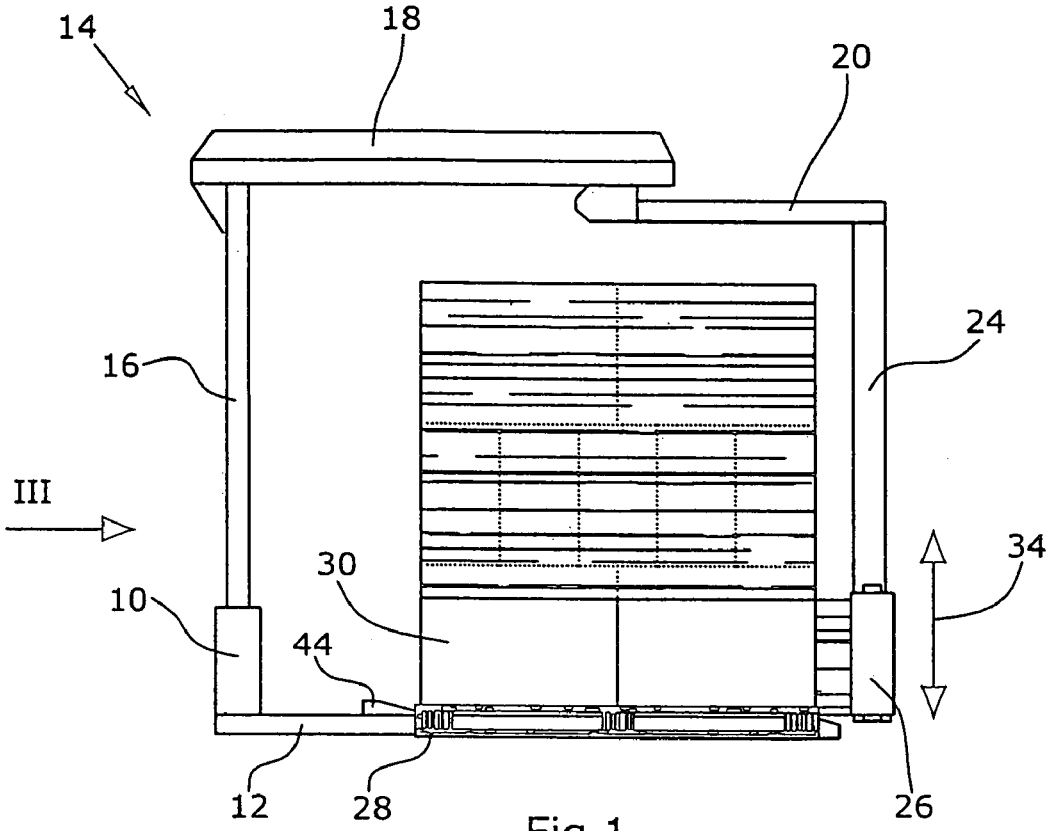
FIG. 1 shows a schematic side view of the wrapping device.
Figure 2:
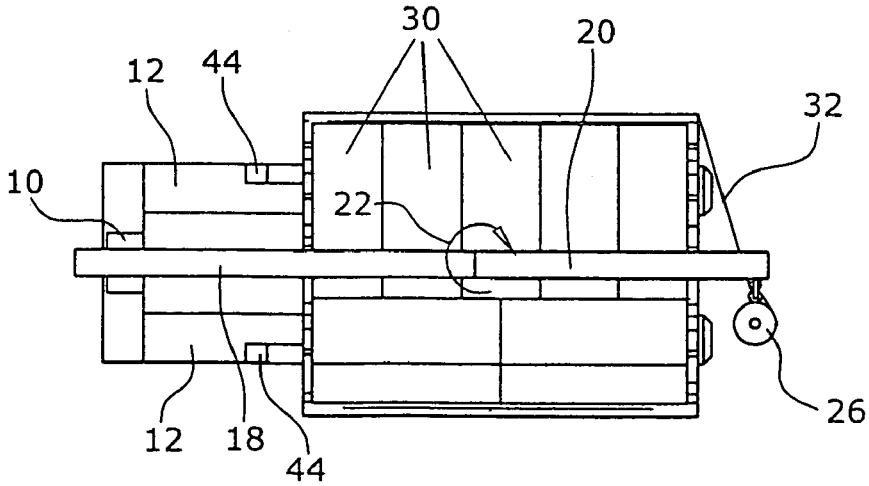
FIG. 2 shows a schematic plan view of the wrapping device.
Figure 3:
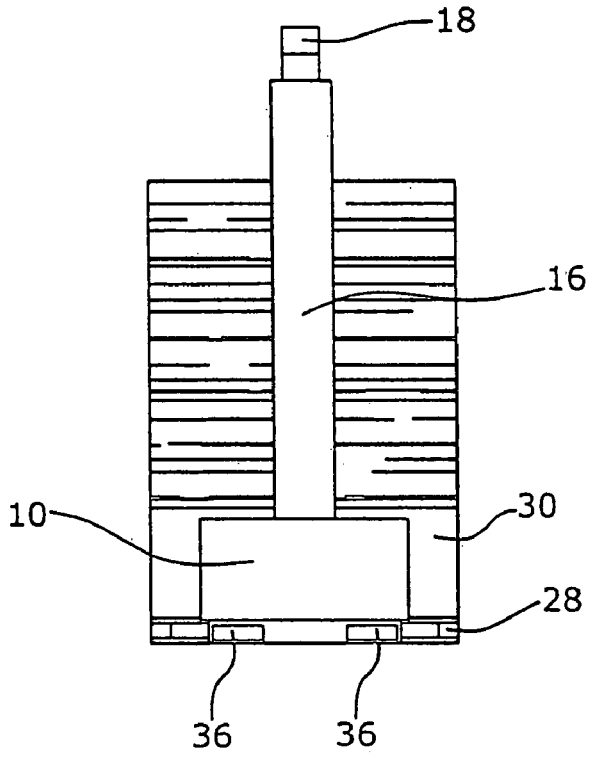
FIG. 3 shows a schematic rear view of the wrapping device, in particular in the direction indicated by arrow III of FIG. 1.
Figure 4:
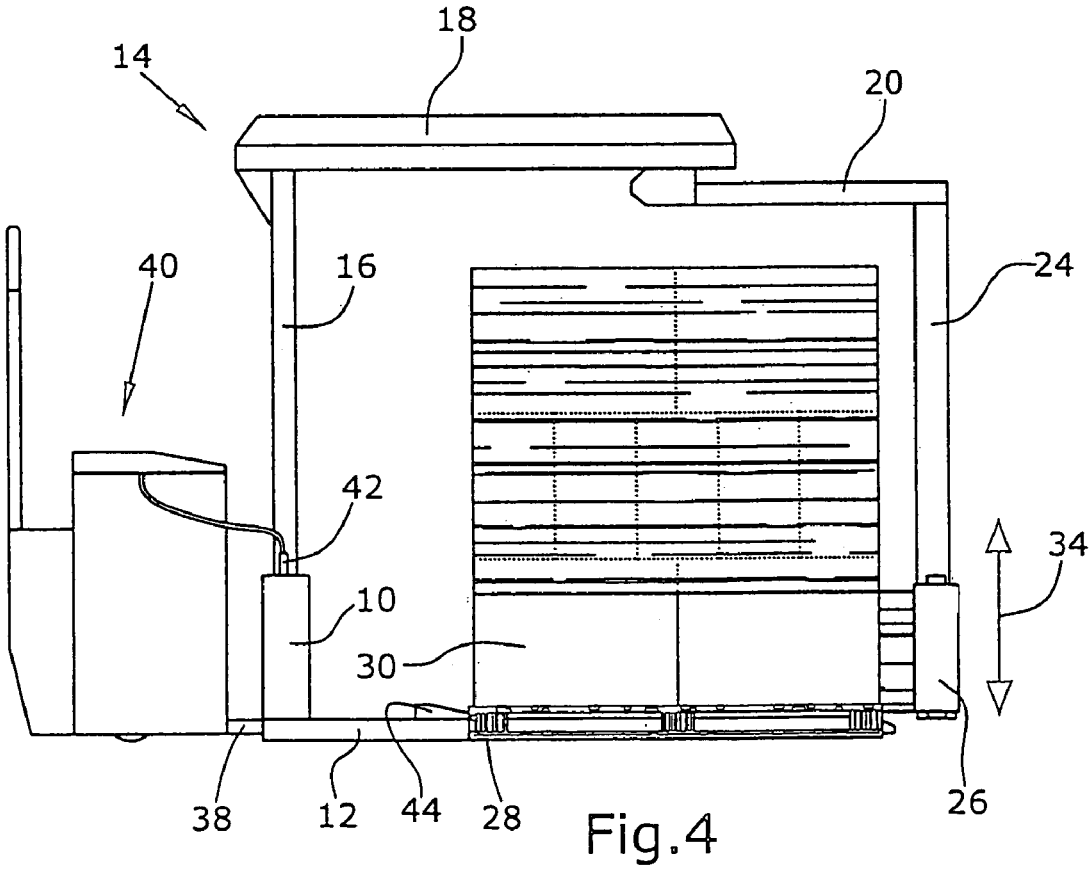
FIG. 4 shows a schematic side view of the wrapping device connected with a lift truck.

The wrapping device according to the invention comprises a base body 10 connected with two support elements 12, wherein the support elements 12 are configured in mutual parallel relationship and in the shape of a fork as in the case of a fork lift truck. The base body 10 has connected thereto an L-shaped holding arm 14. The holding arm 14 comprises a vertically arranged column-shaped portion 16 and a horizontally arranged arm 18. The arm 18 has connected thereto a wrapping arm 20 which is connected to rotate with the arm 18 in the direction indicated by arrow 22. The wrapping arm 20 has rigidly connected thereto a vertically extending roll holder 24. The roll holder 24 carries a film roll 26.

For wrapping-up objects 30 arranged on a pallet 28, the wrapping arm 20, together with the roll holder 24, is turned in the direction indicated by arrow 22 around the objects stacked one on top of the other. Thereby the film sheet 32 is wrapped around the objects 30 for fixing them. For this purpose, the film roll 26 arranged on the roll holder 24 is movable in the direction indicated by arrow 34. The necessary control elements for controlling the wrapping-up process are, for example, arranged in the base body 10.

According to the invention, the support elements 12 are configured as fastening elements. For this purpose, the support elements 12 each comprise a recess 36 such that, in the illustrated embodiment, the support elements 12 are hollow. The support elements 12, whose shape substantially corresponds to the shape of support elements 38 of a lift truck, are preferably hollow such that the support elements and/or the fork-like portions 38 of the lift truck 40 are adapted to be inserted into the support elements 12 serving as fastening elements of the wrapping device according to the invention. Thus a reliable connection between the wrapping device and the lift truck 40 is ensured. Therefore the wrapping device is allowed to be used as a mobile device. It is thus possible both to transport and to wrap up a pallet 28 carrying objects 30 with the aid of the lift truck 40 in combination with the wrapping device according to the invention.

Preferably, the lift truck 40 is an electric lift truck. This offers the advantage that the wrapping device according to the invention must not comprise its own power supply unit but can be connected via a power supply connection 42 with the batteries of the electric lift truck.

Figure 5:
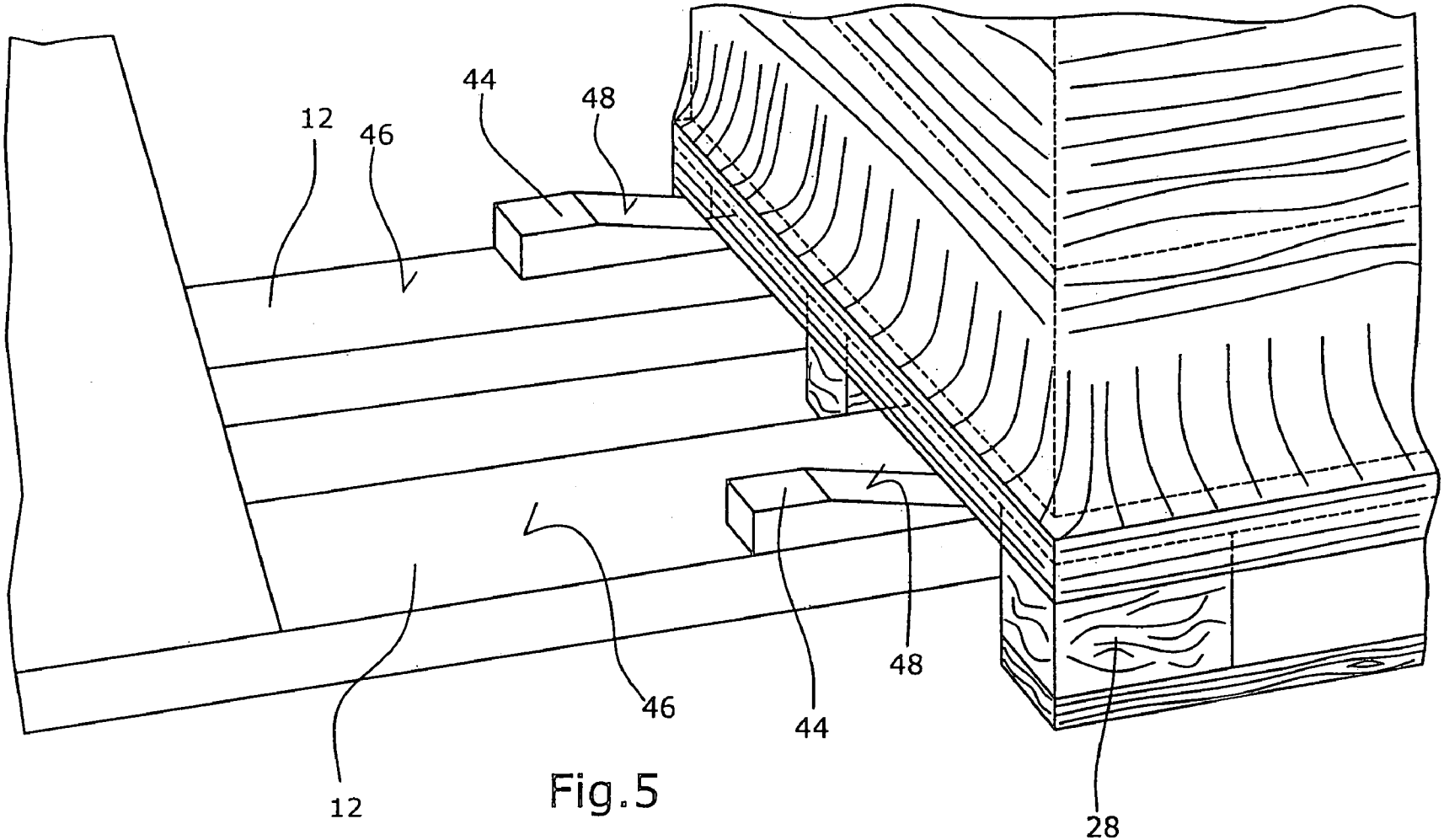
FIG. 5 shows a schematic detail view of the stop elements of the wrapping device.

To prevent the support elements 12 from being pushed too far beneath the pallet 28 such that free turning of the wrapping arm 20, together with the roll holder 28, would no longer be possible, stop elements 44 (FIG. 5) are provided. The stop elements 44 are of wedge-shaped configuration and each stop element is connected with a respective one of the two support elements 12.

The stop elements 44 are arranged on an upper side 46 of the support element 12. In the wedge-shaped portion of the stop elements 44 a friction surface 48 is provided which is inclined relative to the horizontal and slopes towards the pallet 28. The friction surfaces 48 ensure a frictionally engaged connection of the stop elements 44 and thus the wrapping device with the pallet 28 in a defined position.

The invention claimed is:

1. A wrapping device for wrapping objects with a film, said wrapping device comprising:

a base body;

a pole attached to and extending upwardly from said base body;

a holding arm attached to an upper portion of said pole and extending in a forward direction from said upper portion of said pole;

a wrapping arm pivotally connected to a forward end portion of said holding arm;

a pair of forks each of which includes a proximal end attached to said base body, is elongated in said forward direction, terminates at a distal end, and has between said proximal and distal ends a wrapping area in which the objects to be wrapped are to be positioned;

a roll holder for receiving a roll of the film, said roll holder being carried by said wrapping arm and rotatable about said wrapping area; and on an upper surface of each of said forks, a stop element fixed to said upper surface of said fork and defining a rear limit of said wrapping area, wherein said stop element has an upper surface having a front section inclined relative to the upper surface of said fork and sloping in said forward direction towards the distal end of said fork for frictionally engaging the objects to be positioned in said wrapping area.

2. The wrapping device according to claim 1, wherein said stop elements on said forks are identical and elongated in said forward direction.

3. The wrapping device according to claim 1, wherein the upper surface of said stop element further includes a rear section which is contiguous to the front section and substantially parallel with the upper surface of said fork.

4. The wrapping device according to claim 1, wherein the upper surface of said fork in said wrapping area is planar and said front section defines a slope extending continuously, rearwardly and upwardly from the planar upper surface of said fork.

* * * * *